United States Patent [19]

Taylor et al.

[11] Patent Number: 4,798,159

[45] Date of Patent: Jan. 17, 1989

[54] ANCHOR WITH FOLDING SELF-DEPLOYING STABILIZERS

[75] Inventors: Robert J. Taylor; Daniel G. True, both of Camarillo, Calif.

[73] Assignee: The United States of America as represented by the Secretary of the Navy, Washington, D.C.

[21] Appl. No.: 147,967

[22] Filed: Jan. 25, 1988

[51] Int. Cl.[4] ..... B63B 21/26

[52] U.S. Cl. ..... 114/295; 114/302

[58] Field of Search ..... 114/294, 295, 297, 301, 114/302, 303, 304, 309, 310

[56] References Cited

U.S. PATENT DOCUMENTS

| | | | |
|---|---|---|---|
| 60,903 | 1/1867 | Julius | 114/302 |
| 3,263,642 | 8/1966 | Wilson | 114/297 |
| 3,280,783 | 10/1966 | Menning | 114/303 |
| 3,518,957 | 7/1970 | George | 114/297 |
| 3,527,187 | 9/1970 | Towne et al. | 114/302 |
| 3,783,815 | 1/1974 | Towne et al. | 114/302 |
| 3,902,446 | 9/1975 | van den Haak | 114/310 |
| 4,111,147 | 9/1978 | Morissette | 114/303 |
| 4,386,575 | 6/1983 | Brown | 114/297 |

*Primary Examiner*—Sherman D. Basinger
*Assistant Examiner*—Stephen P. Avila
*Attorney, Agent, or Firm*—J. M. St. Amand

[57] ABSTRACT

A self-deploying stabilizer for marine anchors is disclosed wherein the stabilizers fold into a collapsed, compact configuration for easy stowage and automatically self-extend to a working position after anchor deployment for stable anchoring performance. The stabilizers have hinged movable arms which include angled reaction force plates which operate against drag forces created on the plates as an anchor moves through various materials in a marine environment to force the stabilizer arms to move to a fully open position. Springs may be used for assisting or restricting deployment of the movable arms, and lock bolts or break-away shear pins may be provided to retain the movable arms in a desired position.

18 Claims, 3 Drawing Sheets

ANCHOR WITH FOLDING SELF-DEPLOYING STABILIZERS

BACKGROUND OF THE INVENTION

This invention relates generally to marine anchors, and more particularly to self-deploying stabilizers for drag embedment anchors. The self-deploying stabilizers fold into a collapsed, compact configuration for shipment and easy stowage, and automatically self-extend to a working position after anchor deployment for stable anchoring performance. These self-deployable stabilizers function simply and reliably in harsh environments, and can be used to replace standard fixed stabilizers on many high-efficiency drag embedment anchors.

There are a number of marine anchors which have stabilizers hinged to the anchor mechanism. U.S. Pat. Nos. 60,903 and 3,263,642 each disclose folding stabilizer bars which are attached at the upper and mid-section of the anchors, respectively. The stabilizers (stock) of U.S. Pat. No. 60,903 are for the express purpose of preventing fouling of lines. U.S. Pat. Nos. 3,527,187; and 3,783,815 each disclose folding stabilizers which are hinged to the outside bottom edge of the anchor flukes. The folding stabilizers of U.S. Pat. Nos. 3,263,642; 3,527,187; and 3,783,815 were specifically designed for logistic purposes, for convenience in stowage and shipment. In each of the prior patents, the hinged stabilizer arms must be manually extended outwardly in opposite directions from the folded or stowed position prior to deployment of the anchors. In instances, such as with the anchors of U.S. Pat. Nos. 3,527,187 and 3,783,815 the stabilizer arms must then be bolted or locked into the extended position.

None of the prior art anchors provide for automatic extension of the stabilizer arms during deployment of the anchor. The prior art anchors are not designed for stabilizer arm deployment during anchor drag on the seafloor; and, they are not suitable for rapid deployment from a collapsed, compactly stowed configuration.

SUMMARY OF THE INVENTION

The purpose of the present invention is to provide anchor stabilizers that fold into a collapsed, compact configuration for shipment and easy stowage, and particularly for automatically extending to a working position after anchor deployment for stable anchoring performance. The present self-deployable stabilizers apply a restoring moment directly to the anchor crown, where the anchor weight and penetration force aid in mobilizing this moment.

The self-deploying stabilizer assembly for marine anchors generally comprises two major parts: a fixed assembly and a movable assembly. The fixed assembly usually is mounted within and extends through the palm spars of the crown of a marine anchor of a type such as disclosed in U.S. Statutory Invention Registration No. H250, but is applicable to a variety of marine anchors, including several of those mentioned above. The fixed assembly portion of each stabilizer assembly can be either bolted or welded in place. The movable assembly portion of the stabilizer assembly is hinged to the anchor crown and abuts with the outer end of the fixed assembly portion when fully deployed. The movable assembly portion includes an angled plow plate at its outer end which operates in the deployment of the movable stabilizer arm.

A lock bolt and bracket which fits over the outer edge of the fluke is provided for securing the movable stabilizer into a folded compact position with the edge of the fluke during stowage. The lock bolt is removed before anchor deployment. For coral or rock seafloors, an optional breakaway shear pin can be used in place of a lock bolt and remains in place (unsheared) until the anchor is on the seafloor The break-away pin is sheared when force is applied to the plow plate at the end of the movable stabilizer, and the stabilizers move to the fully opened position as the anchor is dragged.

During normal anchor deployment, where lock bolts are used and removed prior to deployment, the movable stabilizer arm is free to open during deployment as the anchor passes through the water during free fall. The stabilizers are rugged and tolerate free fall in the unrestrained mode. Once the anchor reaches the seafloor, it is dragged to set. If not already fully opened during free fall, as the anchor is dragged horizontally the drag forces exerted by the seafloor material on the angled plow plates at the ends of the movable stabilizer arms will cause the stabilizers to move to and remain in the fully open position. The stabilizers function in coral, rock, sand, and mud seafloors.

It is an object of the invention, therefore, to provide marine anchor stabilizers that are self-deployable.

Another object of the invention is to provide a marine anchor with self-extending stabilizers that deploy during free fall to the seafloor.

A further object of the invention is to provide selfdeploying stabilizers for marine anchors that deploy to fully open position as the anchor is dragged on the seafloor.

Other objects, advantages and novel features of the invention will become apparent from the following detailed description of the invention when considered in conjunction with the accompanying drawings wherein like numerals refer to like parts in each of the figures.

DESCRIPTION OF THE PREFERRED EMBODIMENT

Figures 1, 6, 7:
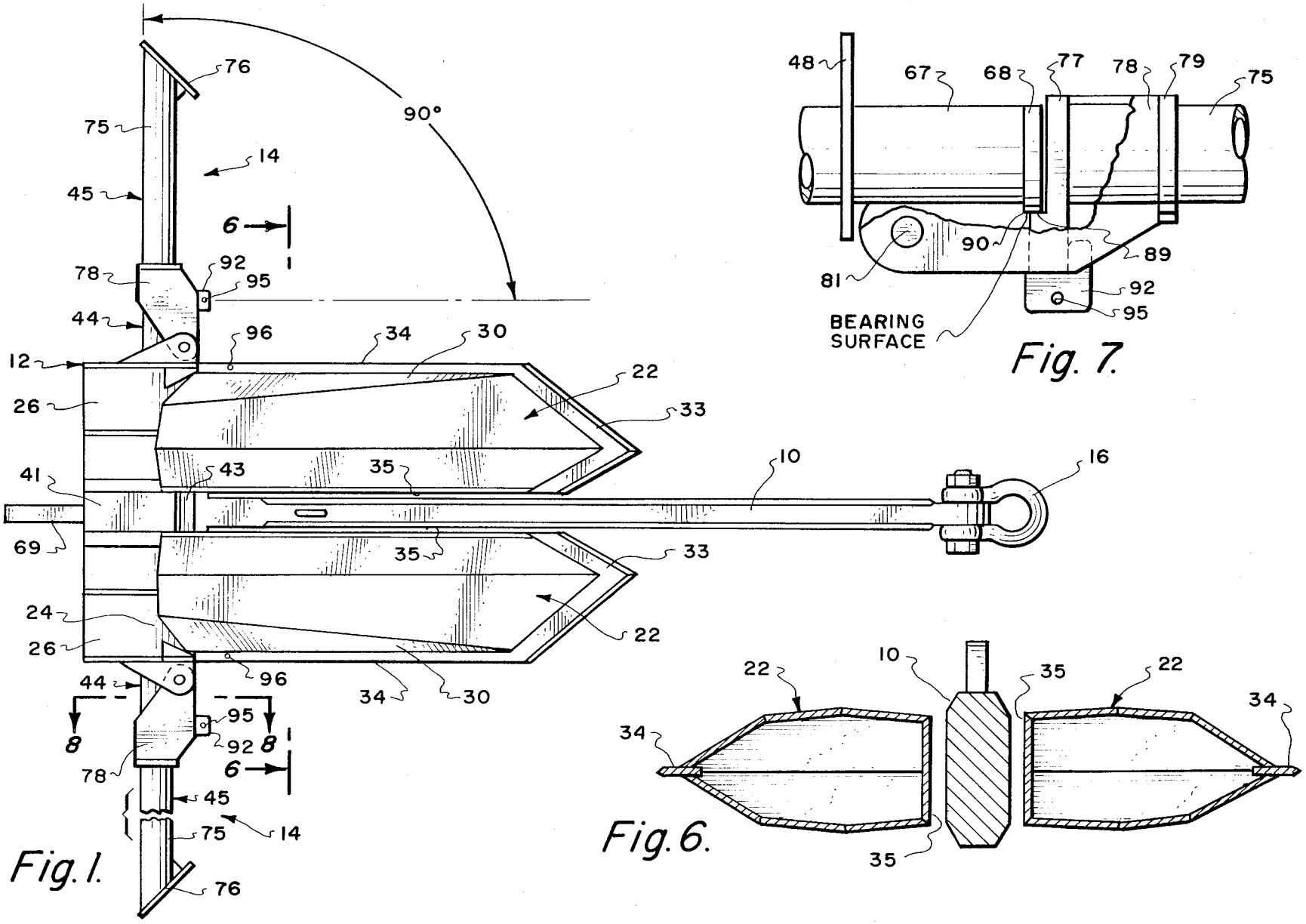
FIG. 1 is a general plan view of a marine anchor showing self-extending movable stabilizers fully deployed.
FIG. 6 is a cross-sectional view taken along line 6—6 of FIG. 1.
FIG. 7 is an enlarged sectional view of the hinged area of the self-deploying stabilizer shown in FIG. 1.
Figure 2:
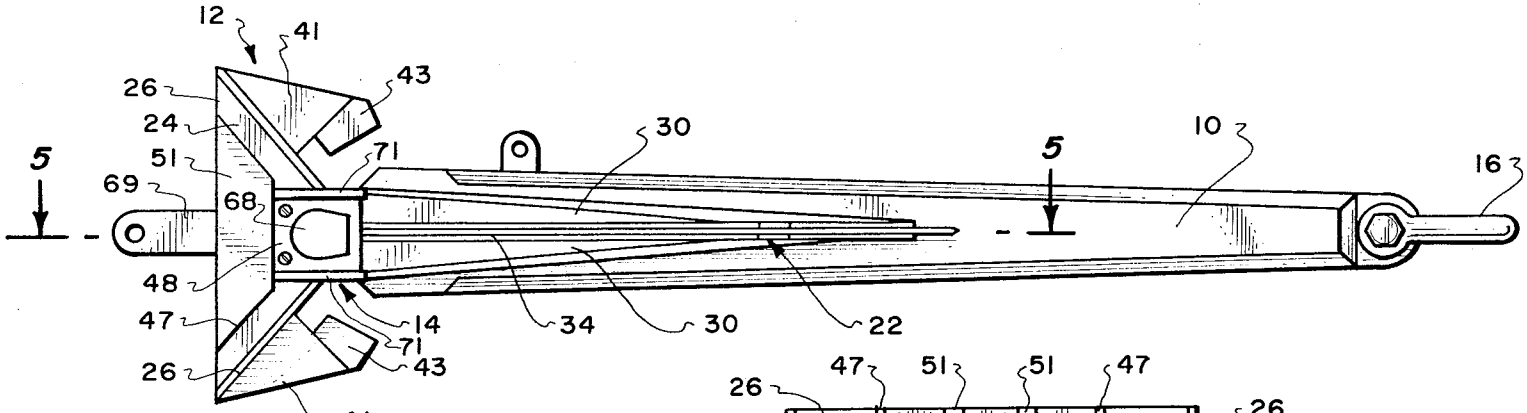
FIG. 2 shows a side view of the anchor of FIG. 1. without the movable stabilizer arms.
Figure 3:
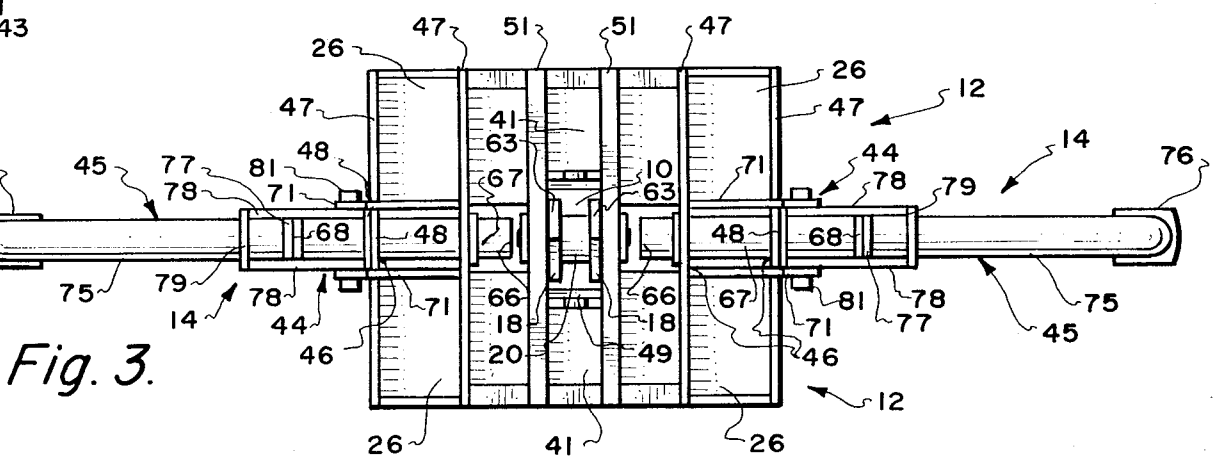
FIG. 3 is a bottom view of the anchor of FIG. 1.

FIGS. 1, 2 and 3 illustrate a high efficiency marine anchor having a shank 10, a fluke assembly 12, and a pair of self-deployable stabilizer arms 14. Additional details of the self-deploying stabilizers are also shown in FIGS. 4, 5, 7, 8 and 9.

Shank 10 is made of plate, cast or forged steel construction. The vertical cross-sectional dimension of the shank provides strength against the bending moment of the flukes and permits penetrability of the shank itself into the ocean bottom. The shank which tapers slightly toward the forward end is attached to the usual shackle 16. The base end of the shank is provided with a padeye 18 and a horizontal concentric bore 19 for receipt of trunion bar or pin 20, shown more clearly in FIG. 5.

The unitary construction of the fluke assembly 12 includes flukes 22, crown 24 and tripping palms 26. The flukes 22 are generally hollow and of box-like construction, as more clearly shown in FIGS. 5 and 6. This type of construction operates to reduce stress, while both streamlining and reducing the weight of the flukes. The flukes are preferably made from steel plate with tapered outer walls 30 and chamfered edge plates along the forward edges 33 and outer sides 34 opposite from the sides adjacent to the shank 10. The fluke walls 35 adjacent to shank 10 are flat and parallel to the shank surface. Flukes 22 are attached to the crown 24 portion of the fluke assembly 12, as shown. The crown and tripping palms portion of the fluke assembly can be made from welded or unitary cast steel construction. The anchor shown, by way of example, uses bilateral fluke construction, where the fluke assembly can move and is fully operable on either side of the shank.

Fluke stoppers 41 are located on the tripping palms 26 and located as far away from the trunion as possible to reduce bending moments on the shank for reducing the weight of the shank and so that the stoppers are less easily damaged. Stoppers 41 can be cast along with the crown and palms as a single unit or separately attached. Stopper wedge pieces 43 are readily attached to the forward ends of stoppers 41, as shown in FIG. 2, for reducing the fluke angle for hard seafloor conditions. Alternately the fluke stoppers can be mounted on shank 10 and positioned a proper distance from the trunion to reduce bending moments.

Figures 5, 8, 9:
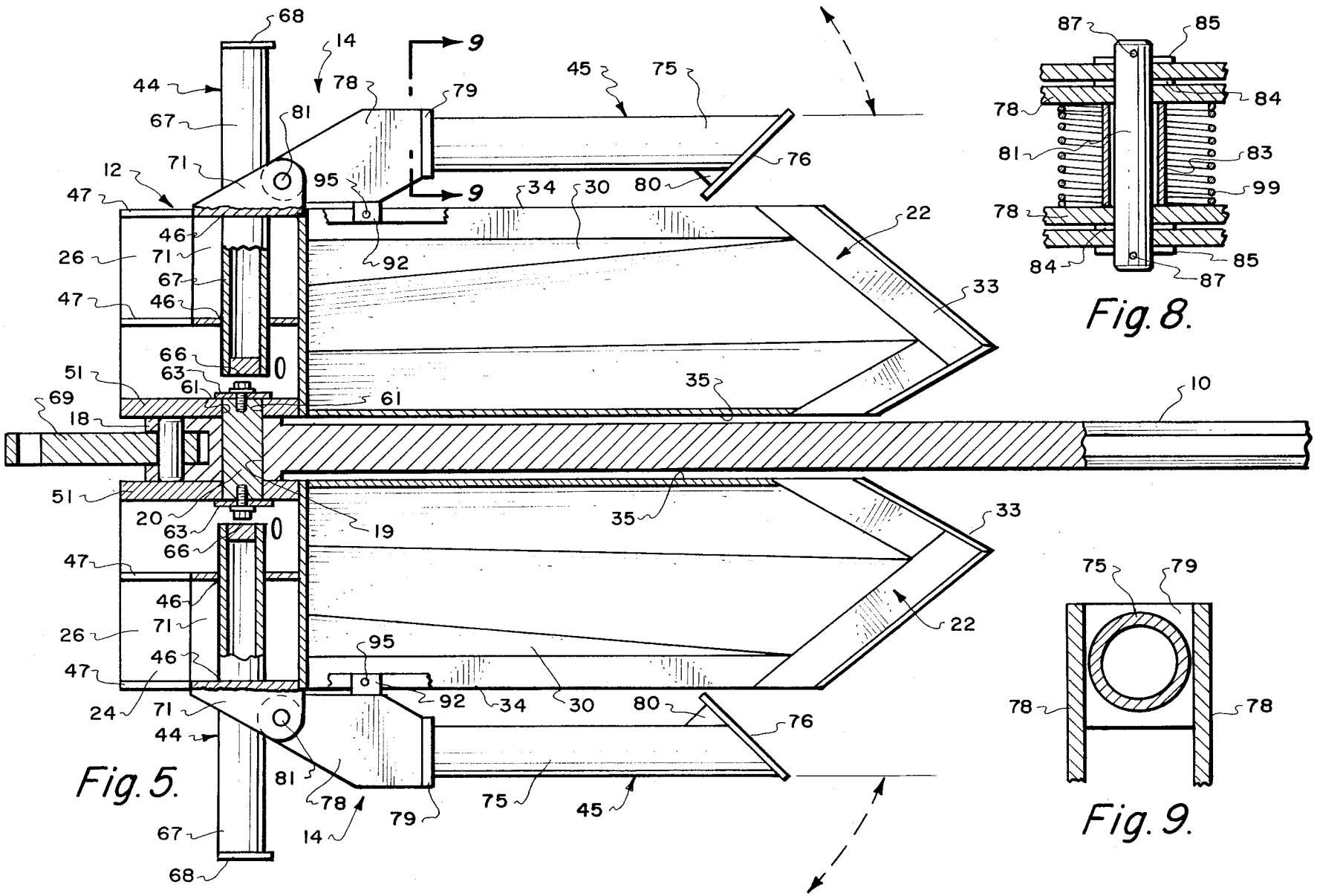
FIG. 5 shows a partially sectional view taken along line 5—5 of FIG. 2.
FIG. 8 is an enlarged cross-sectional view taken along line 8—8 of FIG. 1, also showing an optional spring mechanism.
FIG. 9 is a cross-sectional view taken along line 9—9 of FIG. 5.

Stabilizers 14 comprise two main components, a fixed stabilizer component 44 and a movable stabilizer component 45, as hereinafter more fully described below. A major portion of both of the main components 44 and 45 of the anchor stabilizer assemblies are made from standard heavy duty circular pipe. The fixed stabilizer components 44 are mounted in base sockets formed by holes 46 in stiffening ribs 47 of the crown and palms section of the fluke assembly 12, as shown in FIGS. 3 and 5. Each of the stabilizers 14 can be attached to the outer ribs 47 by means of a flange 48 and bolted on, as shown, or welded in place for permanent mounting, if desired.

Heavy duty padeye 18 is built into the crown of shank so that crown-shackle tandem rigging can be employed when multiple anchor arrangement is required. The crown-shackle rigging method is more stable, does not inhibit the fluke opening 49, and provides an anchor system that is easier to install.

Mud tripping palms 26 are stiffened by the ribs 47 and by extra heavy box beams 51 which form sides to the fluke opening 49. This enables the anchor to withstand harsh environments.

Trunion pin 20 passes through concentric bore 19 in the aft end of shank 10 and through a similar bore 61 in heavy ribs 51 of the fluke assembly. Keeper plates, while not required, may be bolted onto each end of trunion pin 20 to retain the trunion pin in place. The inward ends 66, of the fixed stabilizer assemblies act as a backup to keep the trunion pin in place.

Each of the fixed stabilizer components 44 are formed from a heavy duty pipe section 67 having a head plate 68 at the outer end and closed at the opposite end 66. Mounting flange 48 is used to attach the fixed stabilizer components to the outer stiffening ribs 47 or it may be permanently welded in place, as aforementioned. A pair of palm clevis plates 71, which extend from either side of the fluke assembly 12, are mounted within the palm spar on either side of holes 46 which form base mounting sockets in the stiffening ribs 47 for the fixed stabilizer components, as shown in FIGS. 3 and 5. Palm clevis plates 71 also operate to strengthen the palm spar in the vicinity of holes 46 to provide a strong mounting socket for the stabilizers. A portion of each fixed stabilizer component 44 with head plate 68 extends out a distance from outer stiffening ribs 47, as shown in FIGS. 1, 3 and 5.

Figure 4:
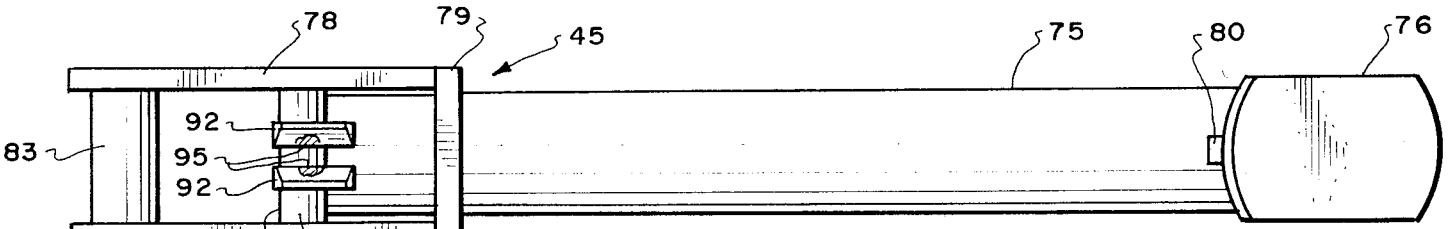
FIG. 4 is an enlarged view of the hidden side of one of the movable stabilizer arms shown in FIG. 3.

The foldable stabilizer components 45 are made from heavy duty pipe sections 75 having plow plates 76 angularly mounted at an acute angle of approximately 45-degrees at the ends thereof and to the longitudinal centerline through the anchor shank 10 when the foldable stabilizers are fully extended, as shown in FIG. 1. Other suitable angles may be used. The plow plates 76 will also be at an angle of approximately 45-degrees to the shank centerline when the stabilizers are moved to the stowed position, as shown in FIG. 5. A shear chock 77 is mounted on the opposite end of each pipe section 75 along with a pair of stabilizer clevis plates 78 and a clevis end plate 79, as shown in greater detail in FIG. 7. Pipe section 75 passes through a hole in clevis end plate 79 (see FIGS. 7 and 9) and is welded to shear chock 77. A wedge piece 80 is added below the lip of plow plate 76 for reinforcement, as shown in FIGS. 1, 4 and 5.

A hinge pin 81 passes through the holes in palm clevis plates 71 and stabilizer clevis plates 78 which assemble together to form a hinge. Hinge pin 81 fits loosely within bushing 83 between the stabilizer clevis plates 78, as shown in FIG. 8; this allows grease to be placed in the void between the bushing and the pin to prevent rust buildup. Washers 84 are used between the palm clevis plates 71 and the stabilizer plates 78. Washers 85 are used on the outside of palm clevis plates 71 and cotter pins (not shown) are used in holes 87 to secure the ends of hinge pin 81.

When the foldable stabilizer components are fully deployed, as in FIG. 1, shear chock 77 bears against the flat surface of head plate 68 and the shear chock lip 89 bears against head plate lip 90, as more clearly illustrated in FIG. 7. The head plates 68 on the fixed stabilizer components are designed to tolerate a large induced shear load. The pipe section 67 is loaded principally in bending. The maximum bending moment occurs at the point where the fixed stabilizer pipe 67 passes through the first palm spar (i.e. stiffening rib 47).

The anchor is shipped and stowed in the closed position, shown in FIG. 5. A lock pin bracket 92 fits over the fluke edge plate 34 and a bolt or shear pin (not shown) is inserted into holes 95 in bracket 92 which match up with hole 96 in edge plate 34 to lock the stabilizer assembly in closed position. Where a bolt is used in holes 95 and 96, the bolt is removed before the anchor is dropped overboard. The normal deployment position for anchors using the self-deploying stabilizers has the foldable stabilizer 45 free to open during deployment. Action of water against the plow plates can cause partial or complete deployment of the stabilizers as the anchor free falls through the water to the seafloor. The stabilizers 45 will be fully opened as the anchor is dragged to set in the seafloor Shear pins are normally not used to restrain the stabilizers during free fall deployment. For coral, rock, etc. seafloors, the lock bolt can be replaced with a shear pin that remains in place (unsheared) until the anchor is on the seafloor. Once the anchor reaches the seafloor and is being dragged horizontally the break-away shear pins will be sheared when drag forces exerted by the seafloor material are applied to the angled plow plates 76 at the end of the movable stabilizer. The stabilizers 45 then move to the fully opened position when the anchor is dragged to set in the seafloor.

The foldable, self-deploying stabilizer device of the present invention provides needed ruggedness for free fall deployment along with needed reliability of functioning to self-extend and stabilize a high-efficiency anchor.

In addition to the welded steel construction shown, the invention may be constructed from cast steel, stainless steel, titanium, aluminum, or other metals suited to marine environment, or of composites or other structural materials found to be suited, consistent with construction of anchors of which the self-deploying stabilizer is a component part. Also, should it be desirable in some circumstances, a spring 99, such as shown in FIG. 8 by way of example, may be added to aid or restrict the extension or retraction of the stabilizer arms to suit individual applications. Likewise, in certain circumstances, such as where it may be desired to have the stabilizers pre-open, be fully deployed, and remain open prior to reaching the seafloor, a locking means (not shown) for retaining the stabilizer arms 45 in the open position can be added to the stabilizer mechanism.

Obviously many modifications and variations of the present invention are possible in the light of the above teachings. It is therefore to be understood that within the scope of the appended claims, the invention may be practiced otherwise than as specifically described.

What is claimed is:

1. In a mooring anchor having a shank assembly and a pivotable fluke assembly for general use in a variety of seafloor materials, the improvement being self-deploying roll stabilizes comprising:

a. a pair of stabilizer assemblies each consisting of a fixed component and a movable component; said stabilizer assemblies being affixed to opposite sides of the pivotable fluke assembly, respectively;

b. said fixed components being mounted on respective opposite sides of the fluke assembly, approximately along the pivot axis of said fluke assembly;

c. each of said movable components being elongated and being connected at one end thereof by hinge means adjacent to an outer end of a respective said fixed component; said movable components capable of being fooled in a forward direction for stowage along the general direction of the anchor shank longitudinal axis and for being opened to extend outwardly in a direction along the fluke pivot axis to a fully operable anchor roll stabilizing position;

d. plow means mounted at outer ends of said movable components; each said plow means comprising a force reaction surface means positioned at an acute angle to the anchor shank longitudinal axis when said elongated movable component is in the stowed position for reacting against various materials which the anchor moves through in a marine environment; said plow means being operable to cause said movable components to swing about said hinge means and deploy said movable components to the fully operable roll stabilizing position.

2. Self-deploying stabilizer means as in claim 1, wherein the outer ends of said fixed components include head plate means, and the hinged end of said movable components include shear chock means which bear against respective said head plate means when the movable components are fully extended and deployed; said head plate means operating to tolerate large induced shear loads when the movable components are fully deployed.

3. Self-deploying stabilizer means as in claim 1, wherein each of the said hinge means connecting said movable components with respective said fixed components comprise: a pair of stabilizer clevis plates mounted on opposite sides of said movable components which interface with a respective pair of palm spar clevis plates mounted in the anchor fluke assembly at opposite sides of said fixed components, and a hinge pin means provided within matching holes in the respective pairs of interfacing stabilizer clevis plates and palm spar clevis plates for interconnecting respective pairs of stabilizer clevis plate with the palm clevis plates to form said hinge means.

4. Self-deploying stabilizer means as in claim 3, wherein said hinge pin means fits loosely within a grease filled bushing between the clevis plates.

5. Self-deploying stabilizer means as in claim 1, wherein a lock bracket means is provided on each movable component which when a movable component is folded in a forward direction cooperates with means on said fluke assembly for holding the movable component in the forward direction until released.

6. A self-deploying stabilizer means as in claim 5, wherein said lock bracket means includes a break-away shear means which retains the movable components in the forward stowed position until the anchor is on the seafloor, and which once the anchor is on the seafloor and being dragged to set in the seafloor the drag forces exerted by seafloor material against the plow means will cause the break-away shear means to be sheared and the stabilizer movable components to be deployed to a full open position.

7. A rugged, self-deploying roll stabilizer for marine anchors having at least a shank and fluke assembly, comprising:

(a) a pair of stabilizer assemblies each having a movable component and being foldably affixed at opposite sides of the anchor fluke assembly;

(b) each said movably component being of a generally elongated configuration and connected at one end by hinge means to the anchor fluke assembly; said movable component being operable to be folded in forward direction along the general direction of the anchor shank longitudinal axis for stowage and also being operable to be opened to extend outwardly in a direction normal to the anchor shank longitudinal axis to a fully operable anchor roll stabilizing position;

(c) force reaction means mounted at outer ends of said movable components; said force reaction means each comprising plow means mounted at an acute angle to the axis lying along the elongated length of a respective said movable component and being operable to react against various materials as the anchor moves through a marine environment to cause said movable components to swing about said hinge means and be fully deployed in the outwardly extended direction normal to the anchor shank longitudinal axis.

8. A self-deploying stabilizer as in claim 7, wherein a locking means is provided in association with each movable component which, when the movable component is folded in a forward direction, operates to hold said movable component in a forward direction adjacent the edge of said anchor fluke assembly until released.

9. A self-deploying stabilizer as in claim 8, wherein said locking mechanism includes a break-away shear means which retains the movable components in a forward stowed position until the anchor is on the seafloor, and which once the anchor is on the seafloor and being dragged to set in the seafloor the drag forces exerted by seafloor material against the force reaction means will cause the break-away shear means to be sheared and the stabilizer movable components to extend and deployed to a fully open position.

10. A self-deploying stabilizer as in claim 7, wherein said pair of stabilizer assemblies each have a fixed component mounted on the anchor fluke assembly and include bearing means which react with shear chock means on each respective movable component, and are operable to withstand large induced shear loads when the movable components are fully deployed.

11. A self-deploying stabilizer as in claim 10, wherein said fixed components extend a distance from the sides of the anchor fluke assembly, and said bearing means comprise a head plate at the outer ends of said fixed components.

12. A self-deploying stabilizer as in claim 7, wherein a major portion of the generally elongated configuration of said movable component is constructed from heavy duty pipe.

13. A self-deploying stabilizer as in claim 7, wherein spring means is provided to aid in the extension of the movable components of the stabilizer.

14. A self-deploying stabilizer as in claim 7, wherein spring means is provided to restrict the extension of the movable components of the stabilizer until the anchor is dragged to set in the seafloor fully deploying the movable components.

15. A self-deploying stabilizer as in claim 7, wherein locking means is provided for retaining said movable components in either of a stowed forward position and a fully deployed position.

16. A high efficency mooring anchor for general use in a variety of marine environments and seafloor materials, comprising:

a. a shank having a forward end with a shackle means for attachment to a mooring cable, an aft end with a trunion bar receiving bore, and a heavy duty padeye means aft of said trunion bar receiving bore;

b. a unitary fluke assembly consisting of a generally angular open box-like crown portion having main sides which also form tripping palms and which meet at an apex pointing toward the forward end of said shank with twin hollow elongated box-like flukes secured to the apex of the crown portion; said crown portion being disposed equally on either side of said shank with said apex parallel to the traverse axis passing through said shank bore and disposed toward the aft end of said shank with relation to said traverse axis;

c. said hollow box-like flukes being tapered and streamlined, disposed on opposite sides of said shank and extending toward the forward end thereof;

d. a trunion bar extending transversely of said shank through said bore, and means in said crown portion of the fluke assembly for receiving said trunion bar for pivotally securing the aft end of said shank to said fluke assembly;

e. a pair of socket means extending into the crown portion of said fluke assembly from either side thereof and axially aligned with said trunion bar; the length of said trunion bar being limited by the inner ends of said socket means;

f. a pair of self-deploying anchor roll stabilizer means, one each removably mounted in said socket means; each said stabilizer means consisting of a fixed component having inner and outer ends, the inner end of which mounts within said socket means, and a movable elongated component having forward and rearward ends, the rearward end of which is hingedly mounted adjacent to the outer end of a respective fixed component; said movable elongated components capable of being folded in a forward direction for stowage along the general direction of the anchor shank longitudinal axis and for being self-deployed and opened to extend outwardly in a direction along the transvers axis passing through the shank bore to a fully operable anchor roll stabilizing position; force reaction means mounted at the forward ends of said movable components and being operable to react against various materials as the anchor moves through a marine environment to cause said movable components to swing about and be fully deployed to an anchor roll stabilizing position;

g. Stopper means mounted on the main sides which form the tripping palms of said unitary fluke assembly at a maximum distance from the transverse axis of said trunion bar receiving bore and aligned to limit the rotation of said fluke assembly and thus the angle of the flukes with respect to said shank and reduce the bending moment on the shank.

17. A mooring anchor as in claim 16, wherein said force reaction means comprises a plow plate means positioned at an angle to the outer end of each of the movable components.

18. A mooring anchor as in claim 16, wherein a locking means is provided for each movable component; each said locking means including a break-away shear means which retains the movable component in the forward stowed position until the anchor is on the seafloor, and which once the anchor is on the seafloor and being dragged to set in the seafloor the drag forces exerted by seafloor material against the force reaction means will cause the break-away shear means to be sheared and the stabilizer movable components to be deployed to a fully open position.

* * * * *